US005244233A

United States Patent [19]

McCraney

[11] Patent Number: 5,244,233

[45] Date of Patent: Sep. 14, 1993

[54] SYSTEM AND METHOD TO ENABLE CHILDREN TO PLACE THEIR SHOES ON THE CORRECT FEET

[76] Inventor: Mary M. McCraney, 20161 McKinley La., Huntington Beach, Calif. 92646

[21] Appl. No.: 798,286

[22] Filed: Nov. 25, 1991

[51] Int. Cl.[5] ..... B42D 15/00

[52] U.S. Cl. ..... 283/070; 40/636; 283/081; 283/114; 283/900

[58] Field of Search ..... 40/630, 636; 283/070, 283/081, 114, 900

[56] References Cited

U.S. PATENT DOCUMENTS

| | | | |
|---|---|---|---|
| 2,473,877 | 6/1949 | Goldstein | 40/636 X |
| 2,650,169 | 8/1953 | Goldstein | 40/636 X |
| 3,258,858 | 7/1966 | Cariffe Jr. | 40/636 X |

OTHER PUBLICATIONS

Pages 774, 775 of Millers Office Products catalog 1989.

*Primary Examiner*—Paul A. Bell

*Attorney, Agent, or Firm*—Hawes & Fischer

[57] ABSTRACT

A system and method for enabling a small child to easily and reliably place his shoes on the correct feet. At least one of the toenails from the child's right foot is painted with a first color from a first bottle of paint, and at least one of the toenails from the child's left foot is painted with a second, contrasting color from a second bottle of paint. A stick-on label having said first color is removed from a first paper strip and applied to the inside of the child's right shoe above the heel thereof, and a stick-on label having said second color is removed from a second paper strip and applied to the inside of the child's left shoe above the heel. The child then matches his right shoe to his right foot, each being marked with the first color and his left shoe to his left foot, each being marked with the second color.

7 Claims, 1 Drawing Sheet

SYSTEM AND METHOD TO ENABLE CHILDREN TO PLACE THEIR SHOES ON THE CORRECT FEET

BACKGROUND OF THE INVENTION

1. Field of the Invention

This invention relates to a color coded system and method to enable young children to easily and reliably place their shoes on the correct feet.

2. Background Art

As will be known to virtually any parent, young children who are old enough to dress themselves frequently place their shoes on the wrong feet. To a large degree, the foregoing problem is caused, because the child cannot adequately distinguish one shoe from the other. Moreover, even if the shoes can be distinguished from one another, there is no reliable way for the child to match his shoes with the correct feet. Consequently, the child may become confused and frustrated over repeated attempts to put his shoes on the correct feet. Likewise, parents may become frustrated over continuously having to correct the placement of their child's shoes. Moreover, the child could fall because his shoes do not fit properly such as when they are placed on the wrong feet. Similarly, shoes that are placed on the wrong feet are likely to be uncomfortable and a source of pain to the child.

Accordingly, it would be desirable to have available a low cost, easy to use system by which to teach children to reliably distinguish their shoes from one another and then place their shoes on the correct feet.

SUMMARY OF THE INVENTION

In general terms, a color coded system and method are disclosed by which to enable young children to easily and reliably place their shoes on the correct feet. The system includes two bottles of non-toxic, peel-off paint that are characterized by contrasting colors, such as orange and green. The system also includes two sets of stick-on labels that have colors (e.g. orange and green) which correspond to the paint. One set of labels is provided with printed indicia such as the letter "R" to denote right, and the other set of labels is provided with printed indicia, such as the letter "L" to denote left.

In use, one of the stick-on labels bearing the letter "R" is placed on the inside of the child's right shoe above the heel. A stick-on label bearing the letter "L" is placed inside the child's left shoe above the heel. Paint matching the color of the stick-on label on the right shoe is applied to one or more of the child's toenails of his right foot. Paint matching the color of the stick-on label on the left shoe is applied to one or more of the child's toenails of his left foot. It will then be a relatively simple task for the child to match the color painted on his right foot with the color of the label applied to his right shoe, as well as the color painted on his left foot with the color of the label applied to his left shoe.

DETAILED DESCRIPTION

Figure 1:
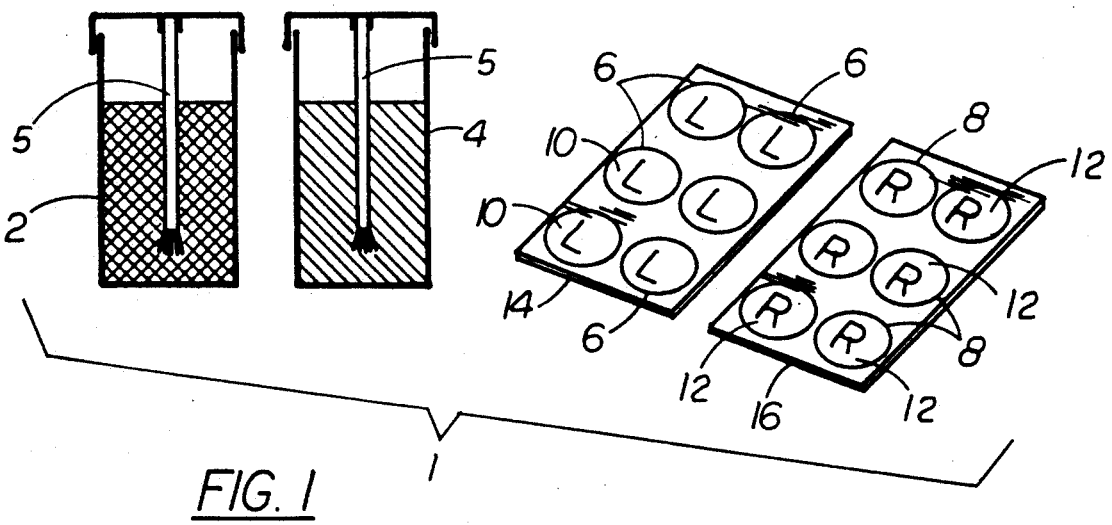
FIG. 1 shows the system of this invention, partially in vertical cross section, for enabling a young child to easily and reliably place his shoes on the correct feet.

Details of the method and color coded system for enabling young children to reliably place their shoes on the correct feet are now disclosed while referring to the drawings. As is shown in FIG. 1, the color coded system 1 includes a pair of bottles 2 and 4 containing non-toxic, easily removable, peel-off paint. Each bottle 2 and 4 includes a conventional applicator, such as a paint brush 5. Since the child using the system 1 has two feet, two bottles containing paint of different colors are required. By way of example only, the first bottle 2 may contain fluorescent orange paint and the second bottle 4 may contain fluorescent green paint. However, any color paint may be selected, although it is preferable that the two colors contrast highly with one another to enable the child to easily distinguish one color from the other. More particularly, it is preferable to select paint that may be easily applied, removed, and recognized by children.

The color coded system 1 also includes two sets of peel off, stick-on labels 6 and 8. Labels 6 and 8 are preferably of the type having colored top surfaces 10 and 12 and self-adhesive bottom surfaces (not shown) to enable labels 6 and 8 to be removably attached to respective paper strips 14 and 16. In addition, the labels may have indicia printed on the top surfaces 10 and 12 thereof which is indicative of the foot upon which each shoe is worn. For example, labels 6 may be marked with the letter "L" which is indicative of the left foot, and labels 8 may be marked with the letter "R" which is indicative of the right foot. While the stick-on labels 6 and 8 are illustrated as being circular, this is for purposes of example only, and labels 6 and 8 may have this or any other geometric configuration that is appealing to children. Similarly, the top surfaces 10 and 12 of labels 6 and 8 may have any contrasting colors, although it is contemplated that the colors at said top surfaces 10 and 12 will correspond with the contrasting colors (e.e. orange and green) of the paint in bottles 2 and 4.

The bottles of paint 2 and 4 and the paper strips 14 and 16 carrying stick-on labels 6 and 8 may be packaged together to form the color coded system 1 of the present invention. By way of example, bottles 2 and 4 and paper strips 14 and 16 are of suitable size to be packaged in what is commonly known as a blister or bubble package (not shown) having a cardboard backing and a transparent shell in which the bottles 2 and 4 and strips 14 and 16 are housed.

Figure 2:
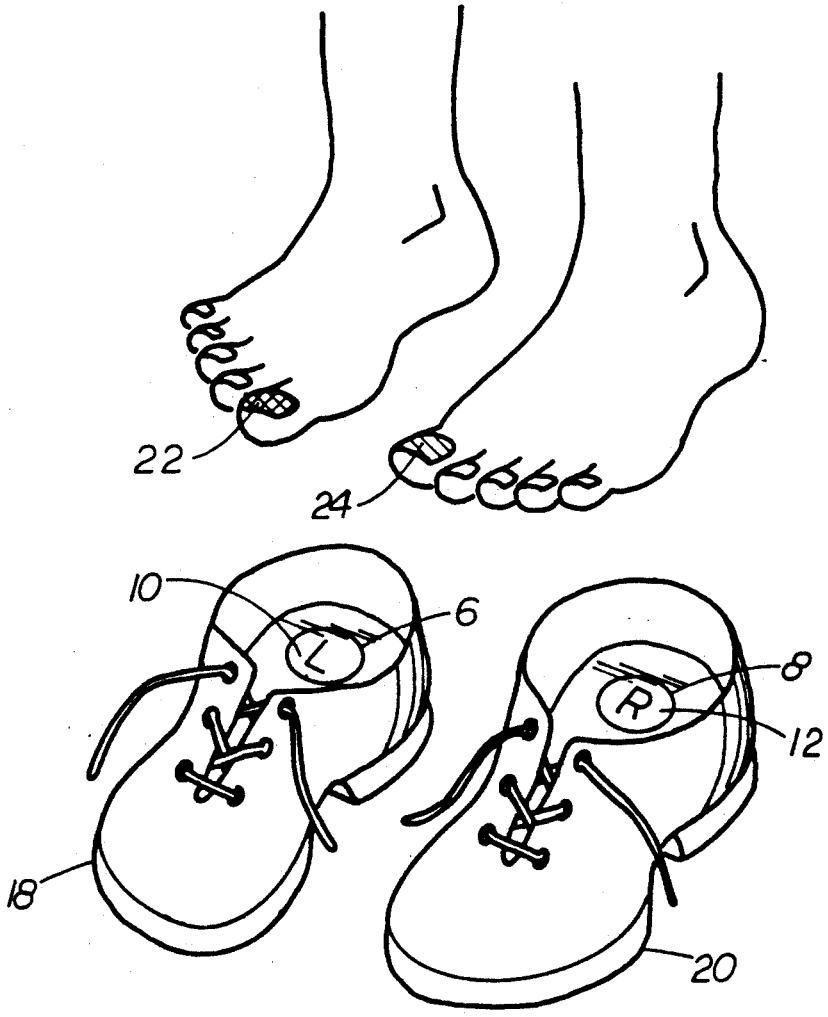
FIG. 2 is illustrative of the method by which the system of FIG. 1 is used with the feet and shoes of a young child.

The method of using the color coded system 1 of FIG. 1 to enable young children to reliably place their shoes onto the proper feet is now described while referring concurrently to FIGS. 1 and 2 of the drawings. An older individual, typically an adult, first peels off one of the colored stick-on labels 6 from its paper strip 14 and presses said label onto a conspicuous location of the left shoe 18 of the pair of shoes belonging to the child. As illustrated, and by virtue of its adhesive backing, stick-on label 6 is easily attached at the inside of the child's left shoe 18 above the heel. Alternatively, or in addition thereto, a label 6 may be applied to the bottom of the shoe 18 at the stepped down area immediately adjacent the heel. The label 6 applied to the left shoe 18 will bear the letter "L" denoting left. A stick-on label 8 of contrasting color is then peeled off its paper strip 16 and pressed onto the same area or areas of the child's right shoe 20 at which the stick-on label 6 is pressed onto the left shoe 18. The label 8 applied to the right shoe 20 will bear the letter "R" denoting right. A plurality of stick-on labels 6 and 8 is provided to enable such labels to be easily replaced if they should become worn out or inadvertently removed.

Next, the bottles 2 and 4 of paint are opened. Paint of a first color (e.g. orange) is applied by brush 5 from the first bottle 2 to one or more of the toenails 22 of the left foot of the child. The color applied to the left foot should match the color at the top surface 10 of the stick-on label 6 on which the letter "L" is printed and which is attached to the child's left shoe 18. Paint of the second color (e.g. green) is applied by brush 5 from the second bottle 4 to one or more of the toenails 24 of the right foot of the child. The color applied to the right foot should match the color at the top surface 12 of the stick-on label 8 on which the letter "R" is printed and which is attached to the child's right shoe 20. For purposes of convenience, and as illustrated in FIG. 2, the paint from bottles 2 and 4 need only be applied to the big toenails 22 and 24 of the child's left and right feet, respectively. However, for decorative purposes, the paint may also be applied to some or all of the remaining toenails.

Thus, the color coded system 1 of FIG. 1 may be applied to the feet and shoes of the child, such that like colors are associated with like feet. This is to say, the toenail 22 of the child's left foot and the child's left shoe 18 are each marked with the same (i.e. orange) color. Likewise, the toenail 24 of the right foot and the child's right shoe 20 are each marked with the same (e.g. green) contrasting color. In addition, the label 6 on the child's left shoe 18 is marked with the letter "L" and the label 8 on the right shoe 20 is marked with the letter "R" to better familiarize the child with the correspondence between the left and right shoes with the left and right feet. It will then be a relatively simple task for the child to match the colors to enable him to easily and reliably place the right shoe on the right foot and the left shoe on the left foot.

It will be apparent that while a preferred embodiment of the invention has been shown and described, various modifications and changes may be made without departing from the true spirit and scope of the invention. For example, the paint in the first bottle may also be applied to the fingernails and/or the socks and/or the shoelaces associated with the left foot, while the paint in the second bottle 4 may be applied to the child's fingernails and/or the socks and/or the shoelaces associated with the right foot.

Having thus set forth a preferred embodiment of the invention, what is claimed is:

1. A method for enabling a child to place his shoes on the correct feet, said method comprising the steps of:

marking a visible area at the right side of the child's body with a first color;

marking a visible area at the left side of the child's body with a second color;

marking the child's right shoe with said first color; and marking the child's left shoe with said second color, such that the right shoe and the right side of the child's body are each marked with said first color and the left shoe and the left side of the child's body are each marked with said second color.

2. The method recited in claim 1, comprising the additional step of respectively painting said first and second colors onto the right and left sides of the child's body.

3. The method recited in claim 1, comprising the additional step of respectively marking at least one toenail from each of the child's right and left feet with said first and second colors.

4. The method recited in claim 1, comprising the additional step of marking the child's right and left shoes by applying respective stick-on labels thereto having said first and second colors.

5. The method recited in claim 4, comprising the additional steps of printing indicia onto the stick-on label applied to the child's right shoe corresponding to the word "right" and printing indicia onto the stick-on label applied to the child's left shoe corresponding to the word "left."

6. The method recited in claim 4, comprising the additional step of applying said stick-on labels to the insides of the child's right and left shoes above the heels thereof.

7. A method for enabling a child to place his shoes on the correct feet, said method comprising the steps of:

painting at least one of the toenails of the child's right foot with a first color;

painting at least one of the toenails of the child's left foot with a second color;

applying a stick-on label having said first color to the child's right shoe; and applying a stick-on label having said second color to the child's left shoe, such that the right shoe and a toenail from the child's right foot are each marked with said first color and the left shoe and a toenail from the child's left foot are each marked with said second color.

* * * * *